US012535275B2

(12) United States Patent
Lee

(10) Patent No.: US 12,535,275 B2
(45) Date of Patent: Jan. 27, 2026

(54) HEAT EXCHANGER

(71) Applicant: HYUNDAI WIA Corporation, Changwon-si (KR)

(72) Inventor: Hyeong Gi Lee, Seoul (KR)

(73) Assignee: HYUNDAI WIA CORPORATION, Changwon-si (KR)

( * ) Notice: Subject to any disclaimer, the term of this patent is extended or adjusted under 35 U.S.C. 154(b) by 128 days.

(21) Appl. No.: 18/457,215

(22) Filed: Aug. 28, 2023

(65) Prior Publication Data

US 2024/0093951 A1 Mar. 21, 2024

(30) Foreign Application Priority Data

Sep. 21, 2022 (KR) ..... 10-2022-0119467

(51) Int. Cl.
*F28D 9/00* (2006.01)

(52) U.S. Cl.
CPC ..... *F28D 9/005* (2013.01); *F28F 2265/16* (2013.01)

(58) Field of Classification Search
CPC ..... F28D 9/005; F28F 2265/16
See application file for complete search history.

(56) References Cited

U.S. PATENT DOCUMENTS 7,866,379 B2 1/2011 Murayama et al.

FOREIGN PATENT DOCUMENTS

| | | | |
|---|---|---|---|
| JP | 2018-105193 A | | 7/2018 |
| KR | 10-2009-0122656 A | | 12/2009 |
| KR | 20090122656 A | * | 12/2009 |
| KR | 10-2014-0083227 A | | 7/2014 |
| KR | 10-2021-0019775 A | | 2/2021 |
| KR | 10-2021-0072861 A | | 6/2021 |

OTHER PUBLICATIONS

Office Action received in Korean Patent Application No. 10-2022-0119467, dated May 30, 2024.
Office Action in corresponding DE Application No. 102023123268.1 dated Oct. 29, 2025.

* cited by examiner

*Primary Examiner* — Eric S Ruppert
(74) *Attorney, Agent, or Firm* — Knobbe, Martens, Olson & Bear, LLP

(57) ABSTRACT

A heat exchanger is disclosed. Different cooling media are circulated in respective independent flow channels between the first heat-exchanging plate and the second heat-exchanging plate so as to perform heat exchange while preventing mixing between the different cooling media. A first guide of the first heat-exchanging plate and a second guide of the second heat-exchanging plate are layered to form an overlapping structure, and thus coupling capability and durability are improved when the first heat-exchanging plate and the second heat-exchanging plate are welded to each other. A discharge path is provided in order to detect internal leakage after welding between the first heat-exchanging plate and the second heat-exchanging plate, thereby making it possible to determine that there is malfunction in the heat exchanger based on the cooling media exposed from the discharge path when the cooling media leaks due to an internal defect.

10 Claims, 7 Drawing Sheets

HEAT EXCHANGER

CROSS-REFERENCE TO RELATED APPLICATION

This application claims the priority benefit of Korean Patent Application No. 10-2022-0119467, filed on Sep. 21, 2022 in the Korean Intellectual Property Office, the disclosure of which is incorporated herein by reference.

BACKGROUND

1. Technical Field

The present disclosure relates to a heat exchanger capable of performing heat exchange between different kinds of cooling media.

2. Description of the Related Art

In general, a heat exchanger is an apparatus configured to perform heat exchange in such a manner that one of different heat-exchanging media discharges heat to the other and the other of the different heat-exchanging media absorbs the heat. The heat exchangers are variously manufactured so as to be applied to a condenser and an evaporator which use refrigerant as a heat-exchanging medium, a radiator and a heater core which use cooling water as a heat-exchanging medium, and an oil cooler which uses oil, which has been used in an engine, a transmission or the like, as a heat-exchanging medium, depending on the intended use.

Details described as the background art are intended merely for the purpose of promoting an understanding of the background of the present disclosure and should not be construed as an acknowledgment of the prior art that is already known to those of ordinary skill in the art.

SUMMARY

Aspects of the present disclosure provide a heat exchanger in which plural kinds of cooling media are circulated in respective independent flow channels and which assures coupling capability and durability of heat-exchanging plates in which heat exchange is performed when the cooling media are circulated and prevents mixed flow of the heat-exchanging media.

In accordance with the present disclosure, the above and other aspects can be accomplished by the provision of a heat exchanger including a first inlet port and a first outlet port through which a first cooling medium flows, a second inlet port and a second outlet port through which a second cooling medium flows, a first heat-exchanging plate to which the first inlet port and the first outlet port are connected and which includes a first guide configured to define a flow channel in which the first cooling medium is circulated, the first guide having a first through hole formed therethrough, and a second heat-exchanging plate to which the second inlet port and the second outlet port are connected and which includes a second guide configured to define a flow channel in which the second cooling medium is circulated, the second guide having a second through hole formed therethrough, wherein each of the first heat-exchanging plate and the second heat-exchanging plate includes a plurality of heat-exchanging plates, and the plurality of first heat-exchanging plates and the plurality of second heat-exchanging plates are alternately layered such that one of the first guide and the second guide is inserted into another of the first guide and the second guide so as to form an overlapping structure and to define a single discharge path through the first through hole and the second through hole.

The first inlet port and the first outlet port may be connected to a first side of the first heat-exchanging plate so as to communicate therewith and the second inlet port and the second outlet port may extend through a second side of the first heat-exchanging plate, and the first inlet port and the first outlet port may extend through a first side of the second heat-exchanging plate and the second inlet port and the second outlet port may be connected to a second side of the second heat-exchanging plate so as to communicate therewith.

The first guide may extend toward the first side and the second side such that the first cooling medium, which is introduced through the first inlet port, detours along the first guide and is discharged through the first outlet port.

The first guide may extend from the first side to a center of the first heat-exchanging plate.

The first guide may include a central portion, which projects so as to be inserted into the second guide and engaged therewith, and a remaining portion, which projects so as to be in contact with a lower surface of the second heat-exchanging plate.

The second guide may extend toward the first side and the second side such that the second cooling medium, which is introduced through the second inlet port, detours along the second guide and is discharged through the second outlet port.

The second guide may extend from the second side to a center of the second heat-exchanging plate.

The second guide may include a central portion, which projects so as to be inserted into the first guide and engaged therewith, and a remaining portion, which projects so as to be in contact with a lower surface of the first heat-exchanging plate.

The first through hole and the second through hole may be aligned with each other in a direction in which the first heat-exchanging plate and the second heat-exchanging plate are layered when the first heat-exchanging plate and the second heat-exchanging plate are layered.

The first guide and the second guide may be projected or depressed so as to form the overlapping structure, and the first through hole and the second through hole may be respectively formed through the projecting surfaces or the depressed surfaces of the first guide and the second guide.

The first through hole and the second hole may be identical in shape and equal in number.

Each of the first heat-exchanging plate and the second heat-exchanging plate may include a plurality of heat-exchanging portions formed on a surface thereof.

BRIEF DESCRIPTION OF THE DRAWINGS

The above and other aspects, features and other advantages of the present disclosure will be more clearly understood from the following detailed description taken in conjunction with the accompanying drawings, in which.

DETAILED DESCRIPTION OF EMBODIMENTS

Figure 1:
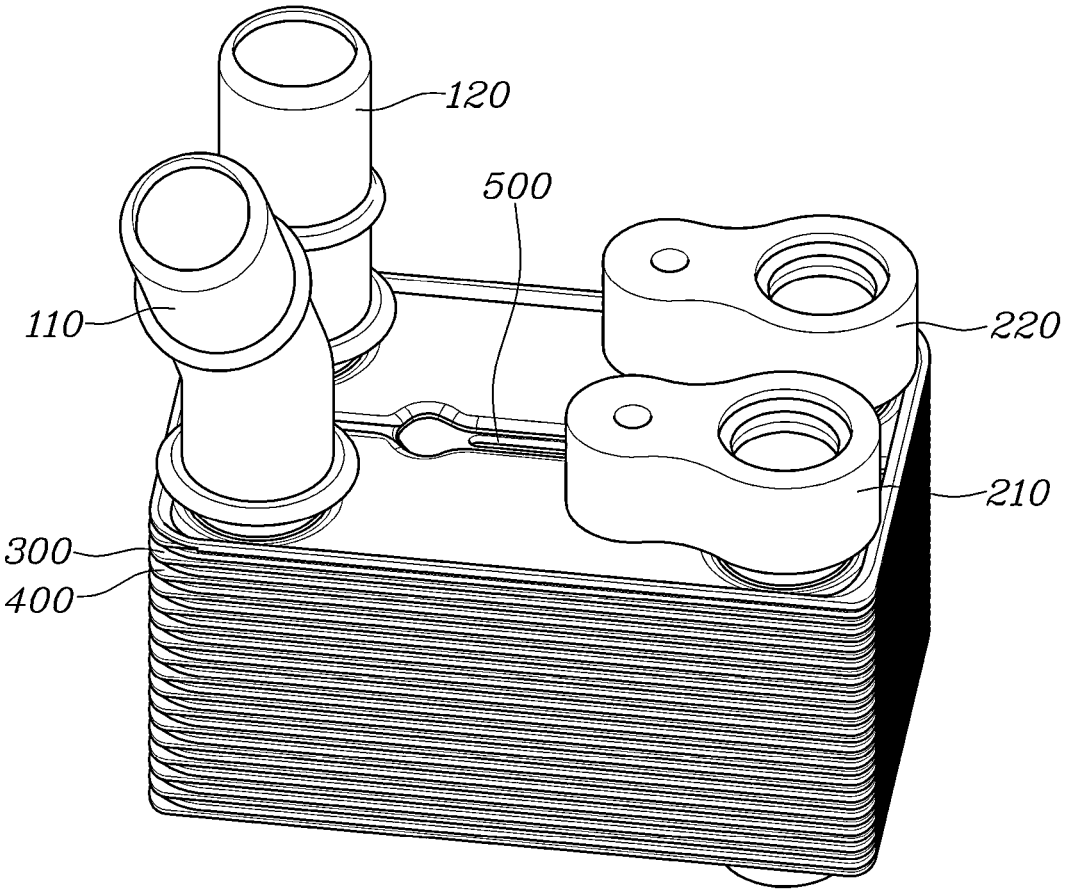
FIG. 1 is a view illustrating a heat exchanger according to an embodiment of the present disclosure.

Reference will now be made in detail to embodiments of the present disclosure, examples of which are illustrated in the accompanying drawings. Wherever possible, the same reference numbers will be used throughout the drawings to refer to the same or like parts.

Air conditioning technology using a heat exchanger is attracting a lot of attention with the development of electric transporter technology. In order to improve efficiency of air conditioning in an electric transporter, energy consumption is reduced through efficient heat exchange between refrigerant and cooling water.

In one example technology, a heat exchanger uses a cooling water plate, in which cooling water is circulated, and a refrigerant plate, in which refrigerant is circulated, in order to perform heat exchange between cooling water and the refrigerant via the cooling water plate and the refrigerant plate. The refrigerant plate, in which refrigerant is circulated, is provided with a partition wall for refrigerant in order to construct a structure for circulating refrigerant, and the cooling water plate, in which cooling water is circulated, is provided with a partition wall for cooling water in order to construct a structure for circulating cooling water. Here, although it is possible to form flow channels in which different kinds of fluid are circulated by virtue of the respective partition walls, a dead zone may need to be present on the cooling water plate and the refrigerant plate in order to form the respective partition. In other words, when the cooling water plate and the refrigerant plate are coupled to each other, there is a need for a portion at which the cooling water partition wall and the refrigerant partition wall are coupled to each other. This portion serves as a dead zone, thereby creating a region in which heat exchange is not performed. This may cause efficiency of heat exchange to be is deteriorated.

In addition, because a groove may need to be formed in one of the cooling water partition wall and the refrigerant partition wall which intersect each other in order to form a cross structure when the cooling plate and the refrigerant plate are coupled to each other, it is possible that heat-exchanging fluid is mixed through the groove.

A description will now be given in detail according to embodiments disclosed herein, with reference to the accompanying drawings. For the sake of brevity of description with reference to the drawings, the same or equivalent components may be denoted by the same reference numbers, and a description thereof will not be repeated.

In general, suffixes such as "module" and "unit", when used in the following description, may be used to refer to elements or components for easy preparation of the specification. The use of such suffixes herein is merely intended to facilitate the description of the specification, and the suffixes do not imply any special meaning or function.

Furthermore, in the following description of embodiments disclosed herein, if it is decided that a detailed description of known functions or configurations related to the disclosure would make the subject matter of the disclosure unclear, such detailed description is omitted. The accompanying drawings are used to assist in easy understanding of various technical features, and it should be understood that the embodiments presented herein are not limited by the accompanying drawings. As such, the present disclosure should be construed to extend to any alterations, equivalents, and substitutes, in addition to those which are particularly set out in the accompanying drawings.

It will be understood that although the terms "first", "second", etc. may be used herein to describe various elements, these elements should not be construed as being limited by these terms. These terms are only used to distinguish one element from another.

It should be understood that, when an element is referred to as being "connected to" another element, there may be intervening elements present, or the element may be directly connected with the another element. In contrast, it should be understood that, when an element is referred to as being "directly connected to" another element, there are no intervening elements present.

A singular representation may include a plural representation unless the context clearly indicates otherwise.

Terms such as "includes" or "has" used herein should be considered as indicating the presence of various features, numbers, steps, operations, elements, components or combinations thereof disclosed in the specification, but it should be understood that the presence or addition of one or more other features, numbers, steps, operations, elements, components or combinations thereof is not excluded.

Hereinafter, a heat exchanger according to an embodiment of the present disclosure will be described with reference to the accompanying drawings.

Figure 2:
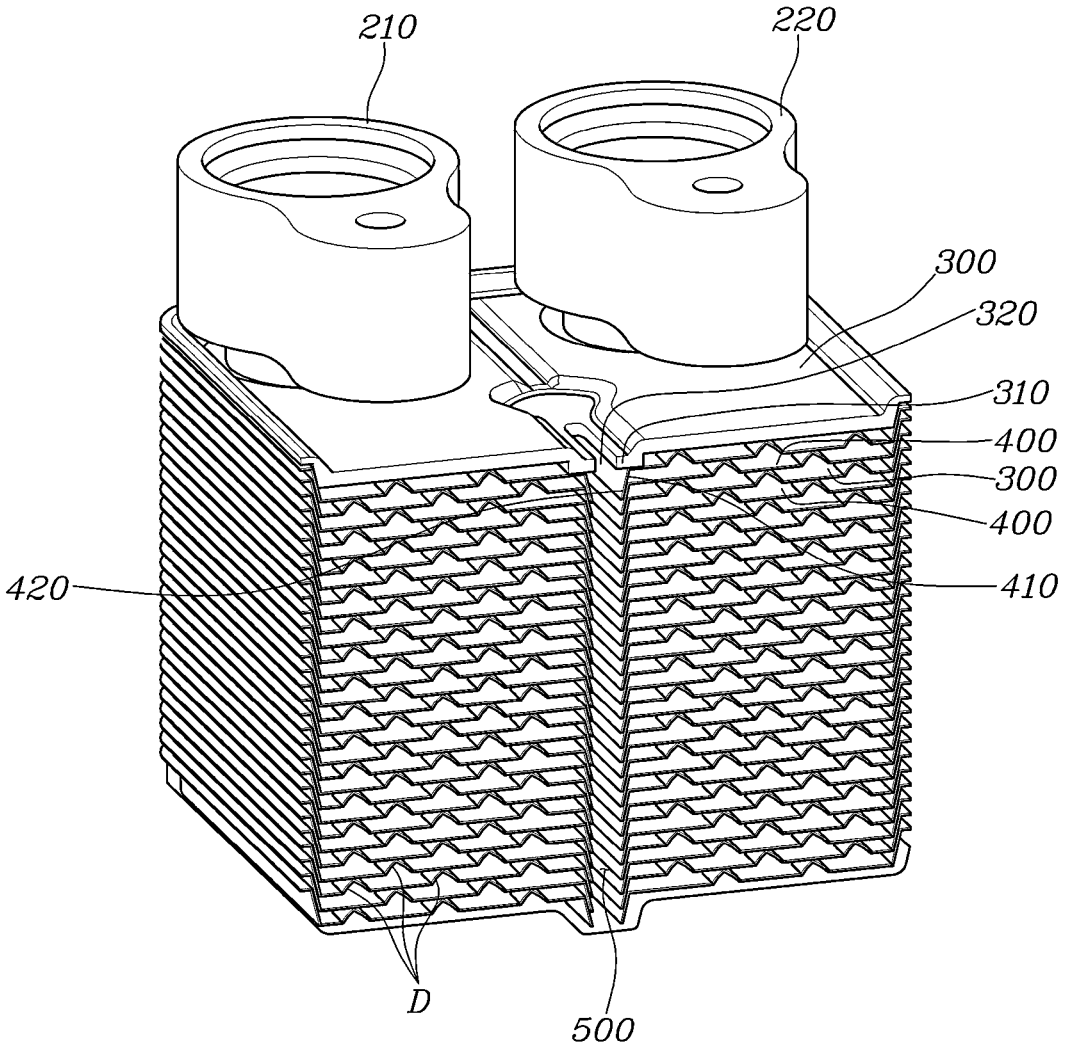
FIG. 2 is a cross-sectional view illustrating the heat exchanger shown in FIG. 1.
Figure 3:
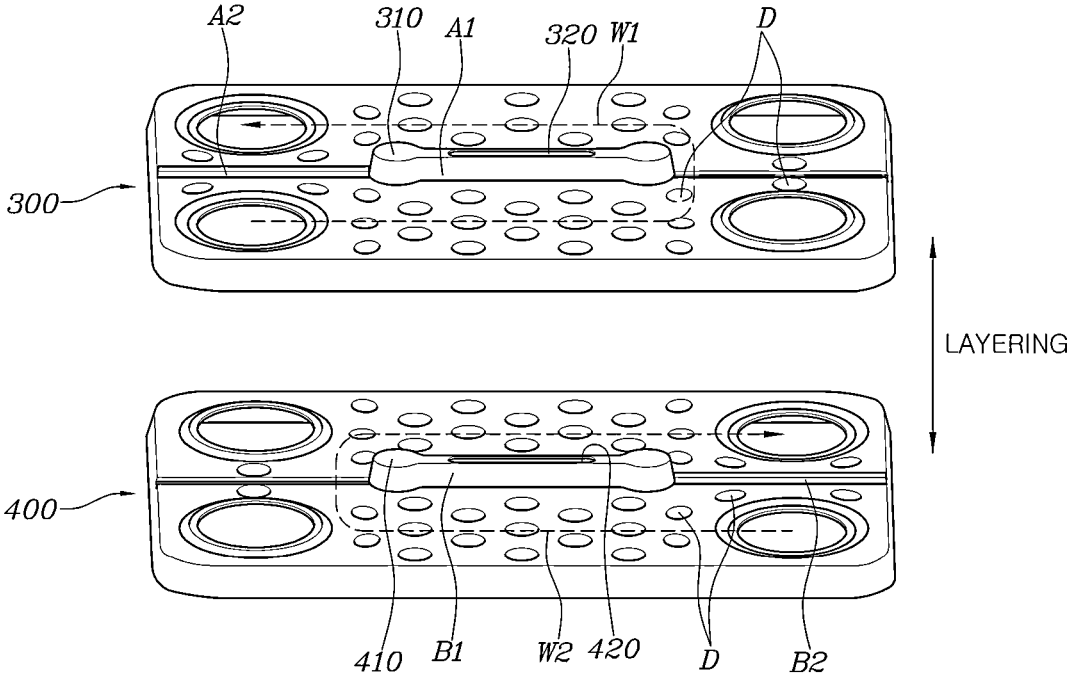
FIG. 3 is a view illustrating a first heat-exchanging plate and a second heat-exchanging plate of the heat exchanger shown in FIG. 1.

FIG. 1 is a view illustrating a heat exchanger according to an embodiment of the present disclosure. FIG. 2 is a cross-sectional view illustrating the heat exchanger shown in FIG. 1. FIG. 3 is a view illustrating a first heat-exchanging plate and a second heat-exchanging plate of the heat exchanger shown in FIG. 1.

Figure 4:
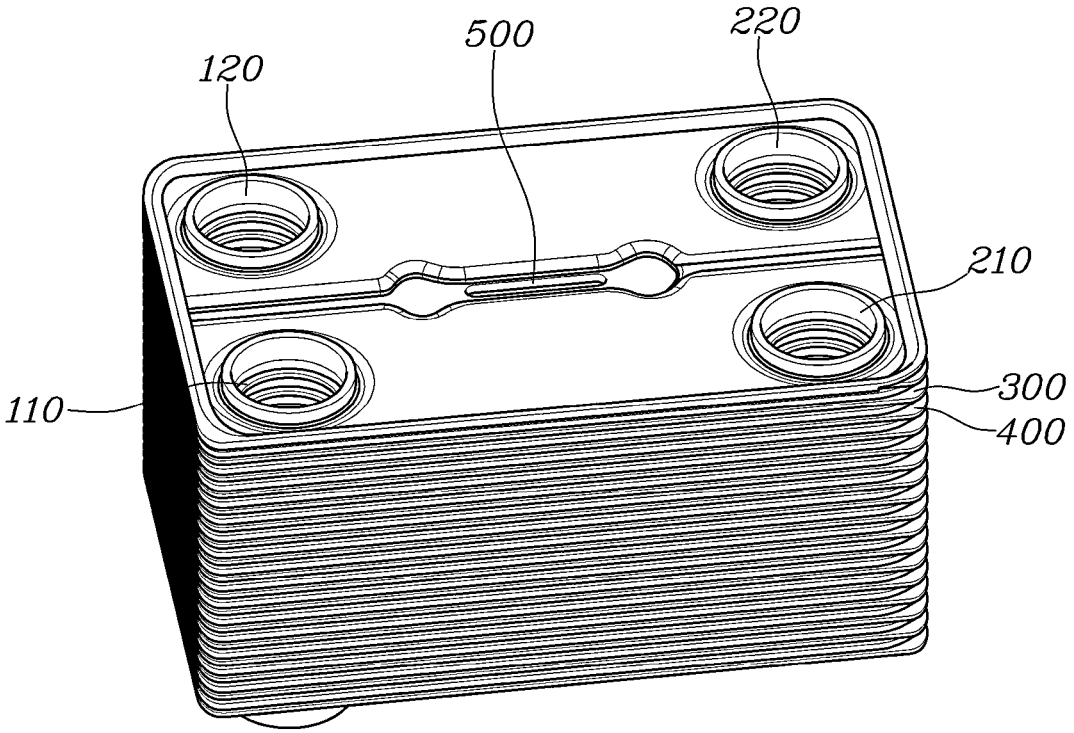
FIG. 4 is a view illustrating an embodiment of a discharge path of the heat exchanger shown in FIG. 1.
Figure 5:
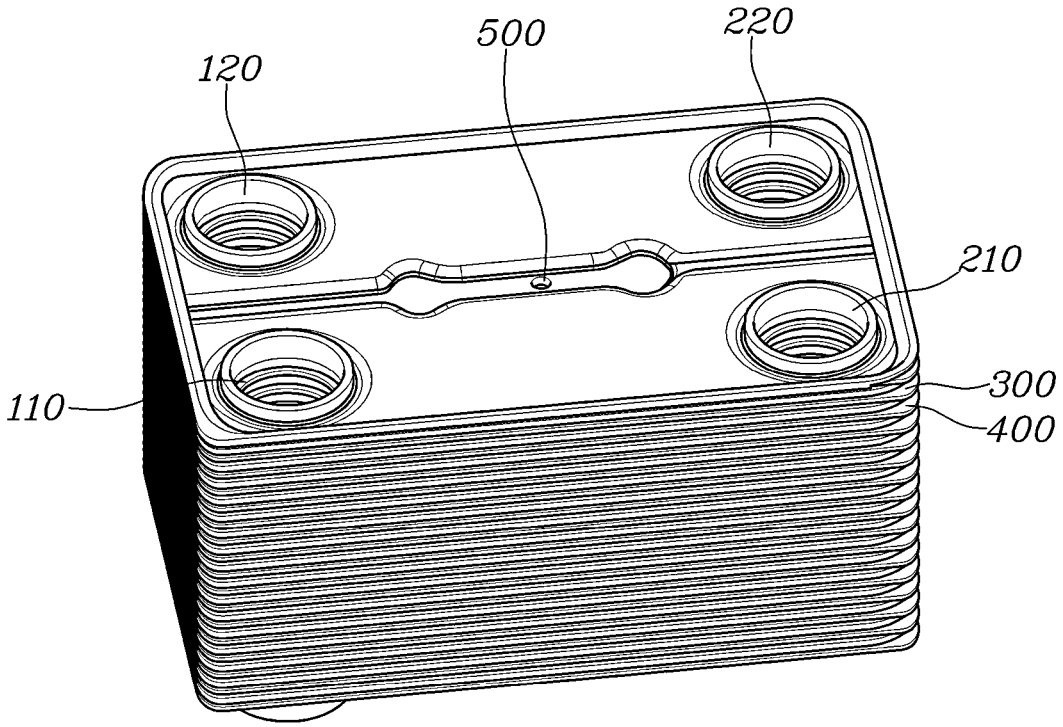
FIG. 5 is a view illustrating another embodiment of the discharge path of the heat exchanger shown in FIG. 1.
Figure 6:
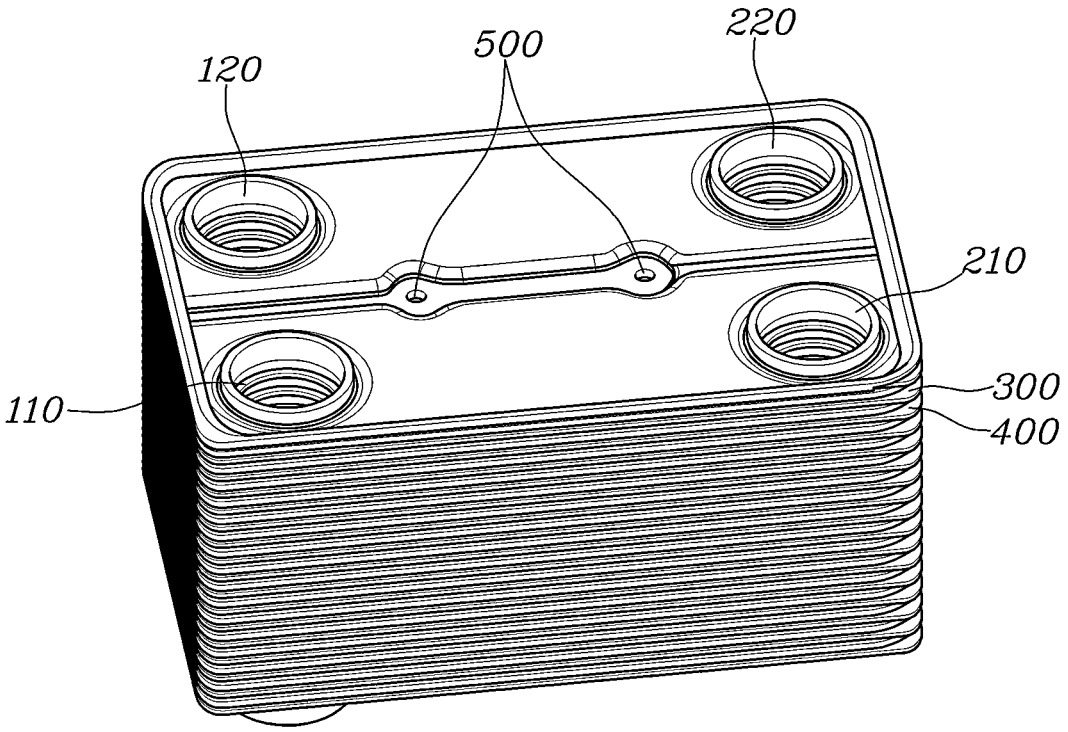
FIG. 6 is a view illustrating a further embodiment of the discharge path of the heat exchanger shown in FIG. 1.
Figure 7:
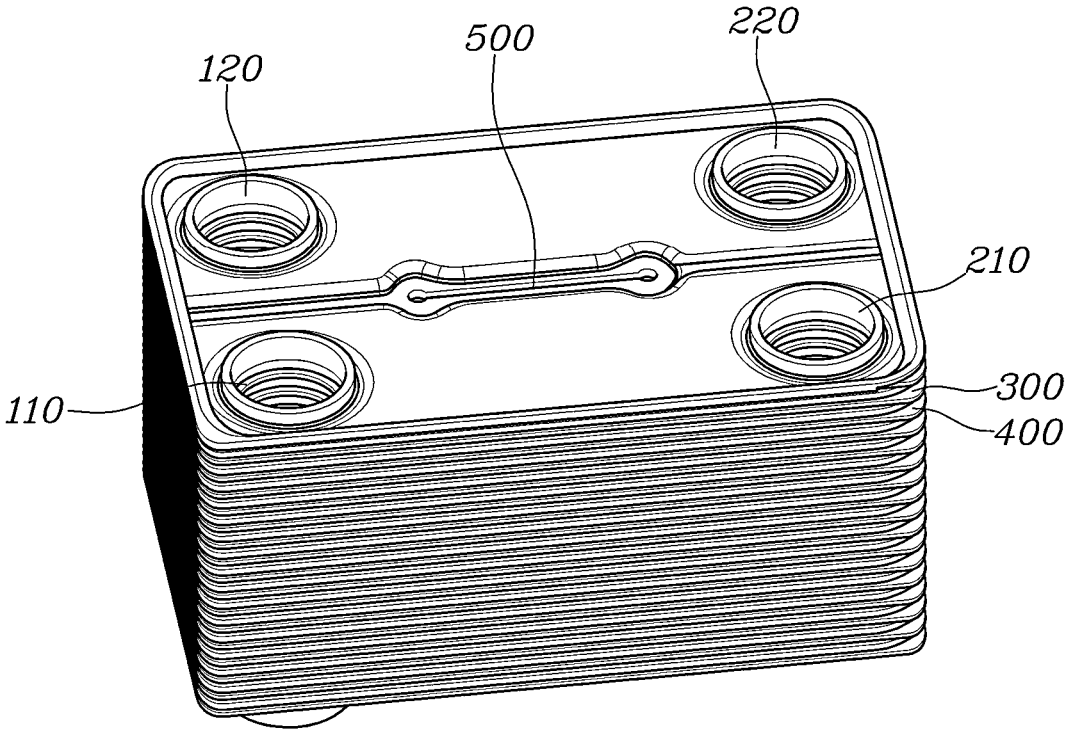
FIG. 7 is a view illustrating still a further embodiment of the discharge path of the heat exchanger shown in FIG. 1.

Furthermore, FIG. 4 is a view illustrating an embodiment of a discharge path of the heat exchanger shown in FIG. 1. FIG. 5 is a view illustrating another embodiment of the discharge path of the heat exchanger shown in FIG. 1. FIG. 6 is a view illustrating a further embodiment of the discharge path of the heat exchanger shown in FIG. 1. FIG. 7 is a view illustrating still a further embodiment of the discharge path of the heat exchanger shown in FIG. 1.

As illustrated in FIGS. 1 to 3, the heat exchanger according to the present disclosure may include a first inlet port 110 and the first outlet port 120 through which a first cooling medium W1 is circulated, a second inlet port 210 and a second outlet port 220 through which a second cooling medium W2 is circulated, a first heat-exchanging plate 300 to which the first inlet port 110 and the first outlet port 120 are connected and which includes a first guide 310 configured to define a flow channel through which the first cooling medium W1 is circulated, the first guide 310 having a first through hole 320 formed therethrough, and a second heat-exchanging plate 400 to which the second inlet port and the second outlet port 220 are connected and which includes a second guide 410 configured to define a flow channel through which the second cooling medium W2 is circulated, the second guide 410 having a second through hole 420 formed therethrough.

The first heat-exchanging plate 300 and the second heat-exchanging plate 400 may be constructed so as to be accommodated in respective separate housings.

The first cooling medium W1 and the second cooling medium W2 may be composed of different kinds of cooling water or refrigerant which are controlled at different temperatures. The first cooling medium W1 and the second cooling medium W2 may be controlled in temperature by being independently circulated or being mixed in a cooling water circuit.

In an embodiment of the present disclosure, the first heat-exchanging plate 300 and the second heat-exchanging plate 400 may include a plurality of first heat-exchanging plates and a plurality of second heat-exchanging plates, respectively, which are alternately layered, and different cooling media may be respectively circulated in the first heat-exchanging plate 300 and the second heat-exchanging plate 400. Consequently, the first cooling medium W1, which is circulated in first heat-exchanging plate 300, and the second cooling medium W2, which is circulated in the second heat-exchanging plate 400, may exchange heat with each other, thereby controlling the temperatures of the respective cooling media.

Each of the first heat-exchanging plate 300 and the second heat-exchanging plate 400 may be provided with a plurality of heat-exchanging portions D formed on a surface thereof in order to improve efficiency of heat exchange between the first cooling medium W1 and the second cooling medium W2. Each of the heat-exchanging portions D may be formed into a protrusion or a groove. The heat-exchanging portions D may be formed on any one of the upper and lower surfaces or on both the upper and lower surfaces of each of the first heat-exchanging plate 300 and the second heat-exchanging plate 400, and may be distributed throughout the surfaces except the areas in which the first guide 310 and the second guide 410 are formed.

The first guide 310 may be formed on the first heat-exchanging plate 300 such that a flow channel is formed between the first inlet port 110 and the first output port 120 so as to allow the first cooling medium W1 to flow therethrough. Furthermore, the second guide 410 may be formed on the second heat-exchanging plate 400 such that a flow channel is formed between the second inlet port 210 and the second outlet port 220 so as to allow the second cooling medium W2 to flow therethrough. The first guide 310 and the second guide 410 allow the first cooling medium W1 and the second cooling medium W2 to be respectively circulated throughout the entire surfaces of the first heat-exchanging plate 300 and the second heat-exchanging plate 400, thereby improving efficiency of heat exchange between the first cooling medium W1 and the second cooling medium W2.

According to an embodiment of the present disclosure, the first guide 310 and the second guide 410 may form an overlapping structure in which one of the first guide 310 and the second guide 410 is inserted into the other of the first guide 310 and the second guide 410 when the first heat-exchanging plate 300 and the second heat-exchanging plate 400 are layered.

The first guide 310 may extend on the first heat-exchanging plate 300 to define a flow channel through which the first cooling medium W1 flows, and the second guide 410 may extend on the second heat-exchanging plate 400 to define a flow channel through which the second cooling medium W2 flows. Here, the first guide 310 and the second guide 410 may be engaged with each other in part of the length or in the full length in a direction in which the first heat-exchanging plate 300 and the second heat-exchanging plate 400 are layered.

In other words, since the first guide 310 and the second guide 410 form an overlapping structure in which one of the first guide 310 and the second guide 410 is inserted into the other of the first guide 310 and the second guide 410, by virtue of the overlapping portion between the first guide 310 and the second guide 410, flow of the cooling medium is blocked, coupling capability between the first heat-exchanging plate 300 and the second heat-exchanging plate 400 is improved, and a dead zone is eliminated.

When a heat-exchanging plate according to an example technology is provided with partition walls for circulation of a cooling medium, a dead zone for avoiding interference between the partition walls may need to be present, and an additional hole for avoiding interference may need to be formed. In contrast, since the present disclosure is constructed such that the first guide 310 of the first heat-exchanging plate 300 and the second guide 410 of the second heat-exchanging plate 400 form an overlapping structure, the dead zone and the additional hole are removed, thereby preventing mixing between the cooling media.

Particularly, according to the present disclosure, a first through hole 320 is formed through the first guide 310 and a second through hole 420 is formed through the second guide 410 such that the first through hole 320 and the second through hole 420 define a single discharge path 500 when the first heat-exchanging plate 300 and the second heat-exchanging plate 400 are layered.

When a plurality of heat-exchanging plates are coupled to each other using the example technology mentioned above, it may be impossible to detect leaks occurring in the heat-exchanging plates although it is easy to detect leaks occurring at the outer surfaces of the heat-exchanging plates. Accordingly, cooling medium cannot be circulated along the flow path for cooling medium which is initially designed, and the cooling medium is bypassed through the portion at which a leak occurs, thereby deteriorating capability of heat exchange.

According to the present disclosure, when the first heat-exchanging plate 300 and the second heat-exchanging plate 400 are coupled to each other such that the first guide 310 and the second guide 410 overlap each other, the first through hole 320 and the second through hole 420 together define a single discharge path 500. Consequently, when cooling medium leaks from the first guide 310 and the second guide 410 after the first heat-exchanging plate 300 and the second heat-exchanging plate 440 are layered, the leaked cooling medium flows along the discharge path 500 and is exposed to the outside, thereby making it possible to check for leakage of the cooling medium.

As described above, when the first heat-exchanging plate 300 and the second heat-exchanging plate 400 are layered, the first guide 310 and the second guide 410 may form an overlapping structure in which one of the first guide 310 and the second guide 410 is inserted into the other of the first guide 310 and the second guide 410, thereby defining a first flow channel in which the first cooling medium W1 flows and a second flow channel in which the second cooling medium W2 flows. As a result, by virtue of the overlapping structure, the overall rigidity of the heat exchanger is improved, and mixing between cooling media is prevented.

Furthermore, since the discharge path 500 is formed by connection of the first through hole 320 in the first guide 310 with the second through hole 420 in the second guide 410, the cooling medium flows out through the discharge path 500 and is exposed to the outside, thereby making it possible to detect the leak. Accordingly, reliability of the heat exchanger is assured.

Hereinafter, the heat exchanger according to the present disclosure will be described in detail. The first inlet port 110 and the first outlet port 120 are connected to a first side of the first heat-exchanging plate 300 so as to communicate therewith, and the second inlet port 210 and the second outlet port 220 extend through a second side of the first heat-exchanging plate 300. Furthermore, the first inlet port 110 and the first outlet port 120 extend through the first side of the second heat-exchanging plate 400, and the second inlet port 210 and the second outlet port 220 are connected to the second side of the second heat-exchanging plate 400 so as to communicate therewith.

As illustrated in FIG. 3, because the first inlet port 110 and the first outlet port 120 are connected to the first side of the first heat-exchanging plate 300 so as to communicate therewith, the first cooling medium W1, which is introduced through the first inlet port 110, is discharged through the first outlet port 120. Here, because the second inlet port 210 and the second outlet port 220 extend through the second side of the first heat-exchanging plate 300, the first cooling medium W1 and the second cooling medium W2 are not mixed.

In addition, because the second inlet port 210 and the second outlet port 220 are connected to the second side of the second heat-exchanging plate 400 so as to communicate therewith, the second cooling medium W2, which is introduced through the second inlet port 210, is discharged through the second outlet port 220. Here, the first inlet port 110 and the first outlet port 120 extend through the first side of the second heat-exchanging plate 400, the first cooling medium W1 and the second medium W1 and the second cooling medium W2 are not mixed.

In this way, the first inlet port 110 and the first outlet port 120 are connected to the first heat-exchanging plate 300 so as to allow the first cooling medium W1 to be circulated in the first heat-exchanging plate 300, and extend through the second heat-exchanging plate 400 so as to bypass the second heat-exchanging plate 400. Meanwhile, the second inlet port 210 and the second outlet port 220 extend through the first heat-exchanging plate 300 so as to bypass the first heat-exchanging plate 300, and are connected to the second heat-exchanging plate 400 so as to allow the second cooling medium W2 to be circulated in the second heat-exchanging plate 400. Consequently, the first cooling medium W1 is circulated in the first heat-exchanging plate 300, and the second cooling medium W2 is circulated in the second heat-exchanging plate 400, with the result that the first cooling medium W1 and the second cooling medium W2 may exchange heat with each other via the first and second heat-exchanging plates 300 and 400.

In addition, since all of the first inlet port 110, the first outlet port 120, the second inlet port 210, and the second outlet port 220 are disposed in the area of the first heat-exchanging plate 300 and the second heat-exchanging plate 400, it is possible to make the overall heat exchanger package compact.

Particularly, because the first guide 310 extends from one side to the opposite side, the first cooling medium W1, which is introduced through the first inlet port 110, may bypass along the first guide 310 and may be discharged through the first outlet port 120.

The first guide 310 may extend from one side to the center of the first heat-exchanging plate 300.

As illustrated in FIG. 3, the first guide 310 may be disposed on the first heat-exchanging plate 300 between the first inlet port 110 and the first outlet port 120 and may extend from one side only to the center in a direction of the opposite side. Consequently, a circulation path in which the first cooling medium W1, which is introduced through the first inlet port 110, flows to the opposite side along the first guide 310, turns at the end of the first guide 310, flows to the one side, and is discharged through the first outlet port 120 is formed. As a result, the range of the first heat-exchanging plate 300 in which the first cooling medium W1 is circulated is increased, and thus an area for heat exchange is increased.

Furthermore, the second guide 410 may extend from the one side toward the opposite side such that the second cooling medium W2, which is introduced through the second inlet port 210, flows along the second guide 410, turns at the end of the second guide 410, and is discharged through the second outlet port 220.

The second guide 410 may extend from the opposite side to the center of the second heat-exchanging plate 400.

Specifically, the second guide 410 may be disposed on the second heat-exchanging plate 400 between the second inlet port 210 and the second outlet port 220, and may extend from the opposite side only to the center in a direction of the one side. Consequently, a circulation path in which the second cooling medium W2, which is introduced through the second inlet port 210, flows toward the one side along the second guide 410, turns at the end of the second guide 410, flows back to the opposite side, and is discharged through the second outlet port 220 is formed. As a result, the range of the second heat-exchanging plate 400 in which the second cooling medium W2 is circulated is increased, and thus an area for heat exchange is increased.

As described above, since the first heat-exchanging plate 300 and the second heat-exchanging plate 400 are constructed such that cooling media are circulated while turning at the ends of the plates by means of the first guide 310 and the second guide 410, an area for heat exchange is increased, and thus efficiency of heat exchange between the first cooling medium W1 on the first heat-exchanging plate 300 and the second cooling medium W2 on the second heat-exchanging plate 400 is improved.

Particularly, the central portion A1 of the first guide 310 that is engaged with the second guide 410 may project so as to be inserted into the second guide 410, and the remaining portion A2 of the first guide 310 may project so as to be in contact with the lower surface of the second heat-exchanging plate 400.

Furthermore, the central portion B1 of the second guide 410 that is engaged with the first guide 310 may project so as to be inserted into the first guide 310, and the remaining portion B2 of the second guide 410 may project so as to be in contact with the lower surface of the first heat-exchanging plate 300.

Since the central portions of the first guide 310 and the second guide 410 are engaged with each other in a vertical direction to form an overlapping structure, direct flow of individual cooling media is blocked, and coupling capability between the first heat-exchanging plate 300 and the second heat-exchanging plate 400 is improved.

Brazing may be applied to weld the first heat-exchanging plate 300 and the second heat-exchanging plate 400. In this case, since one of the first guide 310 and the second guide 410 is inserted into the other of the first guide 310 and the second guide 410 to form an overlapping structure, a contact area therebetween is increased, and thus coupling capability therebetween is improved.

In an embodiment of the present disclosure, only the central portions A1 and B1 of the first guide 310 and the second guide 410 may project highly in order to be engaged with each other, the remaining portion A2 of the first guide 310, which is positioned at the one side, and the remaining portion B2 of the second guide 410, which is positioned at the opposite side, project shortly so as to be respectively coupled to the lower surface of the second heat-exchanging plate 400 and the lower surface of the first heat-exchanging plate 300.

Consequently, the central portion A1 of the first guide 310 and the central portion B1 of the second guide 410 may respectively form bypass paths in order to prevent direct flow of the first cooling medium W1 and the second cooling medium W2 on the first heat-exchanging plate 300 and the second heat-exchanging plate 400. The remaining portion A2 of the first guide 310, which is positioned at the one side, and the remaining portion B2 of the second guide 410, which is positioned at the opposite side, may also prevent direct flow of the cooling media. Even when a fine gap is formed in the remaining portions A2 and B2, fine flow of the cooling medium through the fine gap is allowed, thereby increasing an area for heat exchange. Although the central portion A1 and the remaining portion A2 of the first guide 310 and the central portion B1 and the remaining portion B2 of the second guide 410 are constructed so as to block direct flow of respective cooling media in one embodiment, the central portion and the remaining portion may be respectively formed as an overlapping portion and a contact portion in another embodiment.

The discharge path 500 will now be described in detail. The first guide 310 and the second guide 410 may project or be depressed so as to form an overlapping structure, and a first through hole 320 and a second through hole 420 may be respectively formed through the respective projecting surfaces or the depressed surfaces.

In other words, because the first guide 310 and the second guide 410 project or are depressed, one of the first guide 310 and the second guide 410 may be inserted into the other of the first guide 310 and the second guide 410 so as to form an overlapping structure when the first heat-exchanging plate 300 and the second heat-exchanging plate 400 are layered. Particularly, the discharge path 500 may extend in a vertical direction. Here, because the first through hole 320 is formed through the projecting surface or the depressed surface of the first guide 310 and the second through hole 420 is formed through the projecting surface or the depressed surface of the second guide 410, the first through hole 320 and the second through hole 420 are aligned with each other in a vertical direction, thereby defining the discharge path which extends in a vertical direction.

The first through hole 320 and the second through hole 420 may formed so as to be aligned with each other in a direction in which the first heat-exchanging plate 300 and the second heat-exchanging plate 400 are layered when the first heat-exchanging plate 300 and the second heat-exchanging plate 400 are layered.

In other words, when the first heat-exchanging plate 300 and the second heat-exchanging plate 400 are layered, the first through hole 320 and the second through hole 420 may be aligned with each other in a vertical direction. Consequently, when one of the first guide 310 and the second guide 410 may be inserted into the other of the first guide 310 and the second guide 410 so as to form an overlapping structure, the first through hole 320 and the second through hole 420 are connected to each other so as to define a single discharge path 500.

The first through hole 320 and the second through hole 420 may have the same shape and the same number. Consequently, since the discharge path 500 may extend into a predetermined shape in a vertical direction, leaked cooling medium may easily flow down along the discharge path 500. Furthermore, since the first through hole 320 and the second through hole 420 have the same shape and the same number, concentration of stress at the first through holes 320 in the first guide 310 and the second through hole in the second guide 410 is prevented, thereby improving durability and reliability.

As various embodiments of the discharge path 50, the discharge path 500 may be formed into various shapes, such as a slit shape and a hole shape, as illustrated in FIGS. 4 to 7, and may be designed to have various shapes according to the required rigidity of the first heat-exchanging plate 300 and the second heat-exchanging plate 400, the shape of the first and second guides, and the fluidity of the cooling media.

As is apparent from the above description, the heat exchanger according to the present disclosure is constructed such that different cooling media are circulated in respective independent flow channels between the first heat-exchanging plate and the second heat-exchanging plate so as to perform heat exchange while preventing mixing between the different cooling media.

Particularly, since the first guide of the first heat-exchanging plate and the second guide of the second heat-exchanging plate are layered so as to form an overlapping structure, coupling capability and durability are improved when the first heat-exchanging plate and the second heat-exchanging plate are welded to each other in the state of being layered.

In addition, since the discharge path is provided in order to detect internal leaks after welding between the first heat-exchanging plate and the second heat-exchanging plate, it is possible to determine that there is malfunction in the heat exchanger based on the cooling media exposed from the discharge path when the cooling media leaks due to an internal defect.

In embodiments, a heat exchanger includes a plurality of first heat-exchanging plates, and a plurality of second heat-exchanging plates. The heat exchanger includes a first inlet port and first outlet port, through which a first cooling medium flows. The heat exchanger further includes a second inlet port and a second outlet port, through which a second cooling medium flows.

The plurality of first heat-exchanging plates and the plurality of second heat-exchanging plates are alternately layered to form an alternately layered structure.

In the alternately layered structure, between an upper surface of a first one of the first heat-exchanging plates and a lower surface of a first one of the second heat-exchanging plates placed above the first one of the first heat-exchanging plates, a first flow space is formed. To form one or more water flow channels, each first heat-exchanging plate includes a first flow guide system that includes one or more first partition walls protruding from the upper surface of each first heat-exchanging plate.

In the alternately layered structure, between an upper surface of the first one of the second heat-exchanging plates and a lower surface of a second one of the first heat-exchanging plates placed above the first one of the second heat-exchanging plates, a second flow space is formed. To form one or more second flow channels, each second heat-exchanging plate includes a second flow guide system that includes one or more second partition walls protruding from the upper surface of each second heat-exchanging plate.

In embodiments, at lower surface of each first heat-exchanging plate, the one or more first partition walls may include grooves that can receive top portions of the one or more second partition walls. Similarly, at lower surface of each second heat-exchanging plate, the one or more second partition walls may include grooves that can receive top portions of the one or more first partition walls.

In embodiments, the one or more first partition walls may include top portions abutting the lower surface of the second heat-exchanging plate in the layered structure. The one or more second partition walls may include top portions abutting the lower surface of the first heat-exchanging plate in the layered structure.

Although the preferred embodiments of the present disclosure have been disclosed for illustrative purposes, those skilled in the art will appreciate that various modifications, additions and substitutions are possible, without departing from the scope and spirit of the disclosure as disclosed in the accompanying claims.

What is claimed is:

1. A heat exchanger comprising:

a first inlet port and a first outlet port through which first cooling medium flows;

a second inlet port and a second outlet port through which second cooling medium flows;

a plurality of first heat-exchanging plates, each of which is connected to the first inlet port and the first outlet port and comprises a first guide configured to define a first flow channel in which the first cooling medium is circulated, the first guide having a first through hole formed therethrough; and a plurality of second heat-exchanging plates, each of which is connected to the second inlet port and the second outlet port and comprises a second guide configured to define a second flow channel in which the second cooling medium is circulated, the second guide having a second through hole formed therethrough, wherein the plurality of first heat-exchanging plates and the plurality of second heat-exchanging plates are alternately layered such that one of the first guide and the second guide is inserted into another of the first guide and the second guide so as to form an overlapping structure and to define a single discharge path through the first through hole and the second through hole, wherein the first inlet port and the first outlet port extend through a first side of the second heat-exchanging plate and the second inlet port and the second outlet port are connected to a second side of the second heat-exchanging plate so as to communicate therewith, wherein the second guide extends toward the first side and the second side such that the second cooling medium, which is introduced through the second inlet port, detours along the second guide and is discharged through the second outlet port, and wherein the second guide extends from the second side to a center of the second heat-exchanging plate.

2. The heat exchanger according to claim 1, wherein the first inlet port and the first outlet port are connected to a first side of the first heat-exchanging plate so as to communicate therewith and the second inlet port and the second outlet port extend through a second side of the first heat-exchanging plate.

3. The heat exchanger according to claim 2, wherein the first guide extends toward the first side and the second side such that the first cooling medium, which is introduced through the first inlet port, detours along the first guide and is discharged through the first outlet port.

4. The heat exchanger according to claim 3, wherein the first guide extends from the first side to a center of the first heat-exchanging plate.

5. The heat exchanger according to claim 4, wherein the first guide comprises a central portion, which projects so as to be inserted into the second guide and engaged therewith, and a remaining portion, which projects so as to be in contact with a lower surface of the second heat-exchanging plate.

6. The heat exchanger according to claim 1, wherein the second guide comprises a central portion, which projects so as to be inserted into the first guide and engaged therewith, and a remaining portion, which projects so as to be in contact with a lower surface of the first heat-exchanging plate.

7. The heat exchanger according to claim 1, wherein the first through hole and the second through hole are aligned with each other in a direction in which the first heat-exchanging plate and the second heat-exchanging plate are layered when the first heat-exchanging plates and the second heat-exchanging plates are layered.

8. The heat exchanger according to claim 1, wherein the first guide and the second guide are projected or depressed so as to form the overlapping structure, and the first through hole and the second through hole are respectively formed through projecting surfaces or depressed surfaces of the first guide and the second guide.

9. The heat exchanger according to claim 1, wherein the first through hole and the second through hole have identical shapes and are equal in number.

10. The heat exchanger according to claim 1, wherein each of the first heat-exchanging plate and the second heat-exchanging plate comprises a plurality of heat-exchanging portions formed on a surface thereof.

* * * * *